US007222393B2

(12) United States Patent
Kaffenberger et al.

(10) Patent No.: US 7,222,393 B2
(45) Date of Patent: May 29, 2007

(54) VACUUM CLEANER NOZZLE FOR FLOORS AND CARPETS

(75) Inventors: Dieter Kaffenberger, Wiehl (DE); Thomas Lind, Freudenberg (DE)

(73) Assignee: Wessel-Werk GmbH & Co. KG, Reichshof-Wildbergerhütte (DE)

( * ) Notice: Subject to any disclaimer, the term of this patent is extended or adjusted under 35 U.S.C. 154(b) by 663 days.

(21) Appl. No.: 10/779,027

(22) Filed: Feb. 13, 2004

(65) Prior Publication Data

US 2004/0216268 A1 Nov. 4, 2004

(30) Foreign Application Priority Data

Feb. 20, 2003 (DE) ..... 103 07 176
Mar. 22, 2003 (DE) ..... 103 12 906

(51) Int. Cl.
*A47L 9/06* (2006.01)

(52) U.S. Cl. ..... 15/373; 15/368

(58) Field of Classification Search ..... 15/367–369, 15/373, 393, 401, 402
See application file for complete search history.

(56) References Cited

U.S. PATENT DOCUMENTS

D333,539 S 2/1993 Krämer et al.
5,539,953 A * 7/1996 Kurz ..... 15/367
2002/0083552 A1* 7/2002 Dilger et al. ..... 15/373
2005/0262659 A1* 12/2005 Roschi et al. ..... 15/368

FOREIGN PATENT DOCUMENTS

DE 197 38 046 3/1999

* cited by examiner

*Primary Examiner*—Terrence R. Till
(74) *Attorney, Agent, or Firm*—Collard & Roe, P.C.

(57) ABSTRACT

A vacuum cleaner nozzle has a housing with a plastic upper part, a slide sole and a gasket base pivotably arranged around an axis in the upper part of the housing. There is at least one strip-shaped gasket element that can be retracted and moved out with an adjusting movement of the gasket base at the lower side of the nozzle. The slide sole is fastened to the upper part of the housing with slip joints between pivot-shaped projections on the upper part and counter-elements formed on the slide sole. The gasket base is guided on at least one of the pivots formed by slip joints.

14 Claims, 7 Drawing Sheets

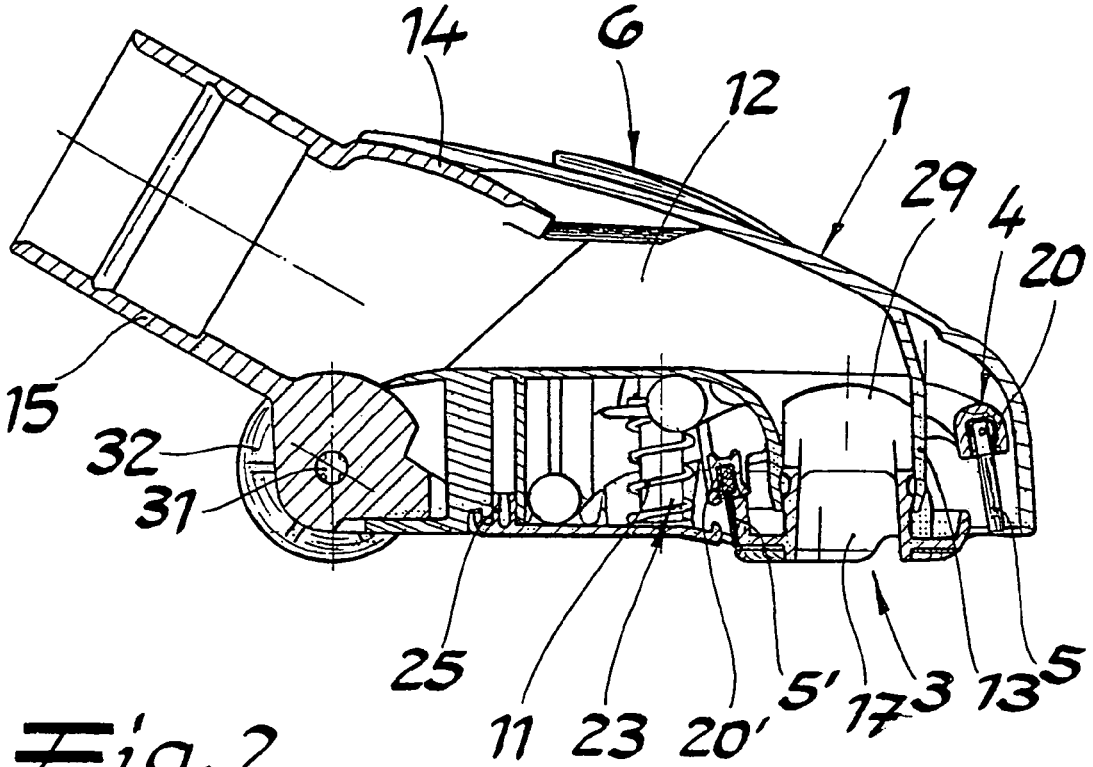
Fig.2
Fig.3
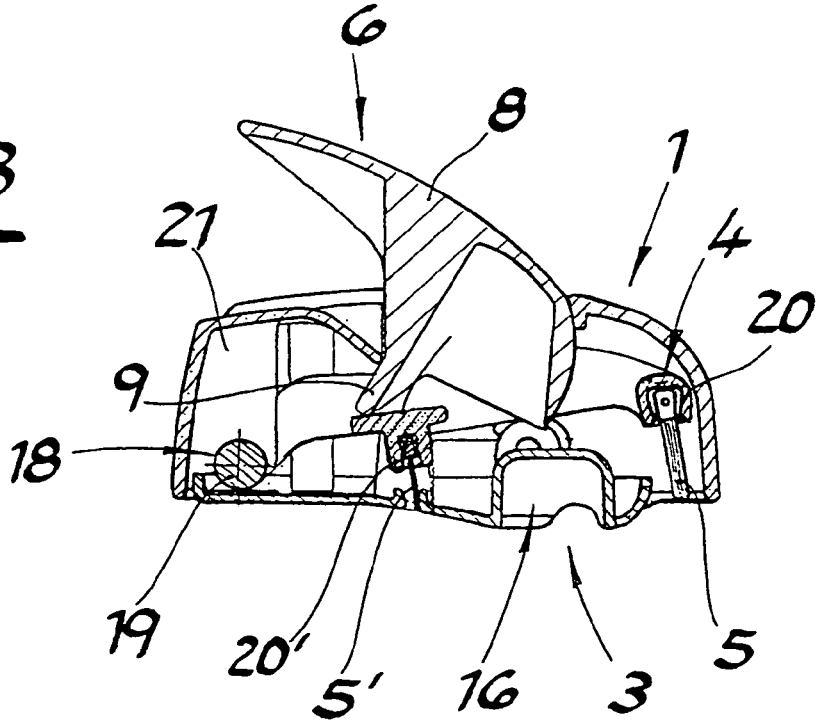

15
31
32
1
7
6
8
19
26
20'
22
20
11
5'
5
25
28'
28
29
17
2
3
30

VACUUM CLEANER NOZZLE FOR FLOORS AND CARPETS

BACKGROUND OF THE INVENTION

1. Field of the Invention

The present invention is related to a vacuum cleaner nozzle for floors and carpets, having a housing part with a plastic upper part, a slide sole with a suction port, a gasket base adjustably arranged inside the upper part of the housing, at least one strip-shaped gasket element that can be retracted and moved out at the lower side of the nozzle with an adjustment movement of the gasket base, a tilting lever to operate the gasket base and return springs that act on the gasket base. A suction channel is formed on the upper part of the housing, which has on one end a connecting piece connected to the slide sole and is developed at the other end as the joint cup of a tilting joint. The suction port is comprised of a flow channel formed into the slide sole, which extends from a central opening running into the suction channel transversely to the suction channel.

2. The Prior Art

Vacuum cleaner nozzles with the aforementioned construction are shown, for example, in U.S. Design Pat. No. D333,539. When vacuuming carpets, the gasket elements, which may be bristle strips or elastomer strips, are retracted into the inside of the housing and the slide sole rests on the floor. To vacuum floors, the gasket elements are moved out at the lower part of the nozzle with an adjusting movement of the gasket base to support the upper part of the housing on the floor. The gasket base is often developed as a metal plate that is arranged to be vertically adjustable in the upper part of the housing and can be lowered against the action of return springs by means of a tilting lever that acts on the base plate. A pivotable arrangement of the base around a stationary pivot axis arranged inside the upper part of the housing at a rear segment is also generally known, as described in German Application No. DE 197 38 046 A1. A bristle strip is connected to the gasket base, which is developed as a rocker, and the bristle strip reaches through a gap between the slide sole and the upper part of the housing in a pivot movement of the gasket base.

During operation of the vacuum cleaner nozzle, great force is exerted on the gasket base, which must be absorbed by the housing. The gasket base, as well as the housing, which is comprised of a slide sole and an upper part, must have a high dimensional stability. Vacuum cleaner nozzles must be produced economically as mass products on modern assembly machines. To lower the production costs, they should be comprised of as few components as possible, and be assembled with a minimum of assembly steps.

SUMMARY OF THE INVENTION

Given this background, it is therefore an object of the invention to provide a vacuum cleaner nozzle having the functions described initially, which is constructed as simply as possible, can be easily assembled, and has a high dimensional stability with economic use of material.

These and other objects are achieved by a vacuum cleaner nozzle in which the slide sole is attached to the upper part of the housing with slip joints between pivot-shaped projections of the upper part of the housing and counter elements formed to the slide sole. The gasket base is pivotably held in a rear segment of the upper part of the housing in a working direction between the formed support webs of the upper part of the housing and the sliding sole, and is guided on at least one of the pivots formed by the slip joints.

The slide sole is preferably comprised of plastic. Furthermore, the gasket base is usefully guided at two pivots formed by the slip joints. The return spring can be developed as a torsion spring and formed directly on the gasket base or the slide sole, for example. In accordance with a preferred embodiment of the invention, however, separate spring elements, for example in the form of coil springs, are provided. In another embodiment, the gasket base has formed support surfaces for the return springs with one respective guide recess and a pivot reaching through the guide recess. The return springs are arranged on the pivots between the slide sole and the support surfaces of the gasket base.

The vacuum cleaner nozzle is constructed of few elements and can be assembled without screws. In the assembly, the tilting lever, the gasket base and the return valves are positioned as insertion parts in the upper part of the housing. Then the slide sole is engaged with the upper part of the housing. This completes the assembly. The pivots formed by the slip joints have multiple functions. For one, they brace the housing and in particular lend the slide sole high usage stability. Furthermore, they form guides for the return springs as well as for the pivot movement of the gasket base. They are permanent joints that cannot be removed without destruction.

The counter elements of the slide sole that cooperate with the pivot-shaped projections in the upper part of the housing are usefully developed as stump-shaped cylindrical elements with a mushroom head. A plurality of these elements are arranged across the surface of the slide sole. In accordance with a preferred embodiment of the invention, catch projections are additionally formed at the slide sole, which can be affixed to the connecting piece of the upper part of the housing and at the wall surfaces of the upper part of the housing. They snap into the appropriate counter elements and lend the sliding sole additional stability in these areas.

In a preferred embodiment of the invention, the gasket base is comprised of a pin-jointed frame plastic molding having a rod with cylindrical bearing surfaces and at least one profile strip parallel to the rod and being connected to the gasket element as a longitudinal member. There are also cross-members arranged on both sides of the suction channel to connect the longitudinal members. The gasket element that supports the profile strip is arranged in a working direction upstream of the connecting piece of the suction channel.

In an especially preferred embodiment of the invention, the gasket base has two profile strips that brace the plastic molding to connect gasket elements, with the profile strips being arranged in a working direction in front of and behind the suction port. The gasket element connected to the rear profile strip can be retracted or moved out through a gap in the slide sole that is preferably developed in one piece.

Bristle strips, rubber lips, dimensionally stable plastic strips, foamed material strips and the like can be fastened to the profile strips of the gasket base in random combinations depending on the respective application. In a preferred embodiment, a bristle strip is attached to the front profile strip and a strip of elastomer material is attached to the rear profile strip.

The tilting lever is usefully comprised of a pivotable shaft, at least one actuating surface developed as an impact switch as well as formed cam lobes that act on an assigned contact surface of the gasket base and can also be developed as plastic molding.

The gasket base usefully has two respective cross-members on both sides of the suction channel, which are spaced such that the impact switch dips into the free space between adjacent cross-members. The contact surfaces that cooperate with the tilting lever are also usefully arranged between the cross-members.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2 shows a longitudinal section along lines II—II through the nozzle of FIG. 1;

FIG. 3 shows a sectional view along lines III—III of the nozzle of FIG. 1;

DETAILED DESCRIPTION OF THE PREFERRED EMBODIMENT

Figure 1:
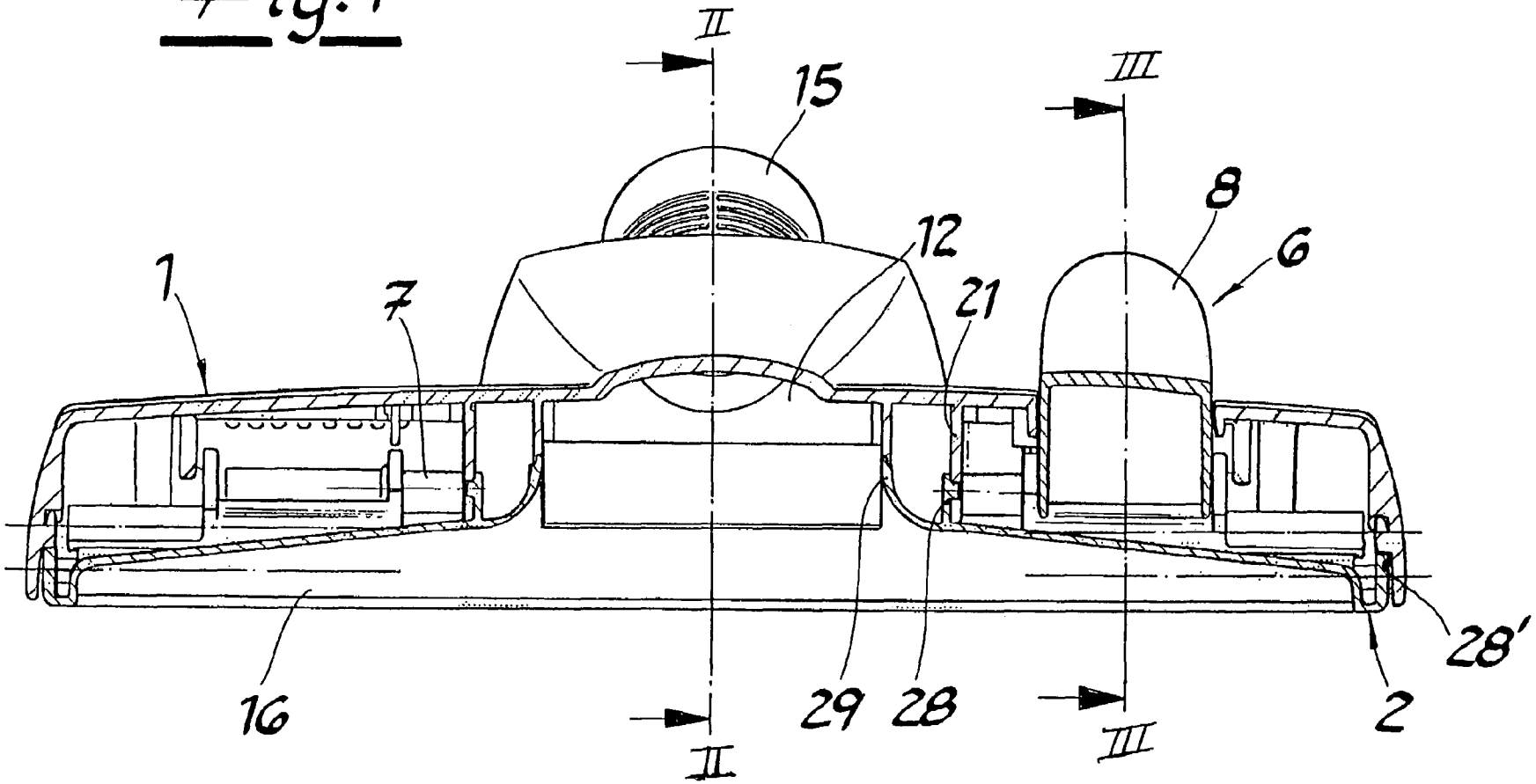
FIG. 1 shows a frontal sectional view of the vacuum cleaner nozzle in accordance with the invention.

The vacuum cleaner nozzle shown in the figures can be used for floors and carpets, either directly or with the interconnection of a flexible line on the suction side of a vacuum cleaner device. The principal structure of the vacuum cleaner nozzle includes an upper part 1 of the plastic housing and a plastic slide sole 2 having a suction port 3 as well as a gasket base 4 adjustably arranged inside the upper part 1 of the housing. The gasket base has at least one strip-shaped gasket element 5 that can be retracted and moved out at the lower side of the nozzle with an adjusting movement of the gasket base 4. There is a tilting lever 6 comprised of a pivotable shaft 7, at least one actuating surface developed as an impact switch 8 as well as formed cam lobes 9 that act on a respective contact surface 10 of gasket base 4, as well as return springs 11 acting on gasket base 4. A suction channel 12 is formed on upper part 1 of the housing, which has on its one end a connecting piece 13 connected to the slide sole 2 and is developed at the other end as joint cup 14 of a hinge joint 15. Suction channel 12 forms a projection in the inside of the housing comprised of upper part 1 and slide sole 2. Suction port 3 is comprised of a flow channel 16 formed into slide sole 2, which extends from a central opening 17 that runs into suction channel 12 transversely to suction channel 12.

Gasket base 4 is pivotably arranged in upper part 1 around an axis 18 and is comprised of a pin-jointed frame plastic molding having as a first longitudinal member a rod 19 with cylindrical bearing surfaces, for example in form of an integral shaft, and parallel to the rod two profile strips 20, 20' that brace the pin-jointed frame as additional longitudinal members to connect gasket elements 5, 5'. Profile strips 20, 20' are arranged in front of and behind suction port 3 in working direction, with a bristle strip 5 being connected to the front profile strip 20 and a rubber lip 5' being connected to the rear profile strip 20'. During a pivot movement of the gasket base 4, bristle strip 5 reaches through a gap between slide sole 2 and upper part 1 of the housing. Gasket lip 5' can be retracted and moved out through a gap in integrally developed slide sole 2. Rod 19, which is developed with cylindrical support surfaces, for example as a shaft, is rotationally held in a rear segment of upper part 1 of the housing in working direction, between slide sole 2 and formed bearing webs 21 of upper part 1 of the housing. Longitudinal members 19, 20, 20' are connected by proportionally formed cross-members 22 arranged at both sides of suction channel 12.

Figure 6:
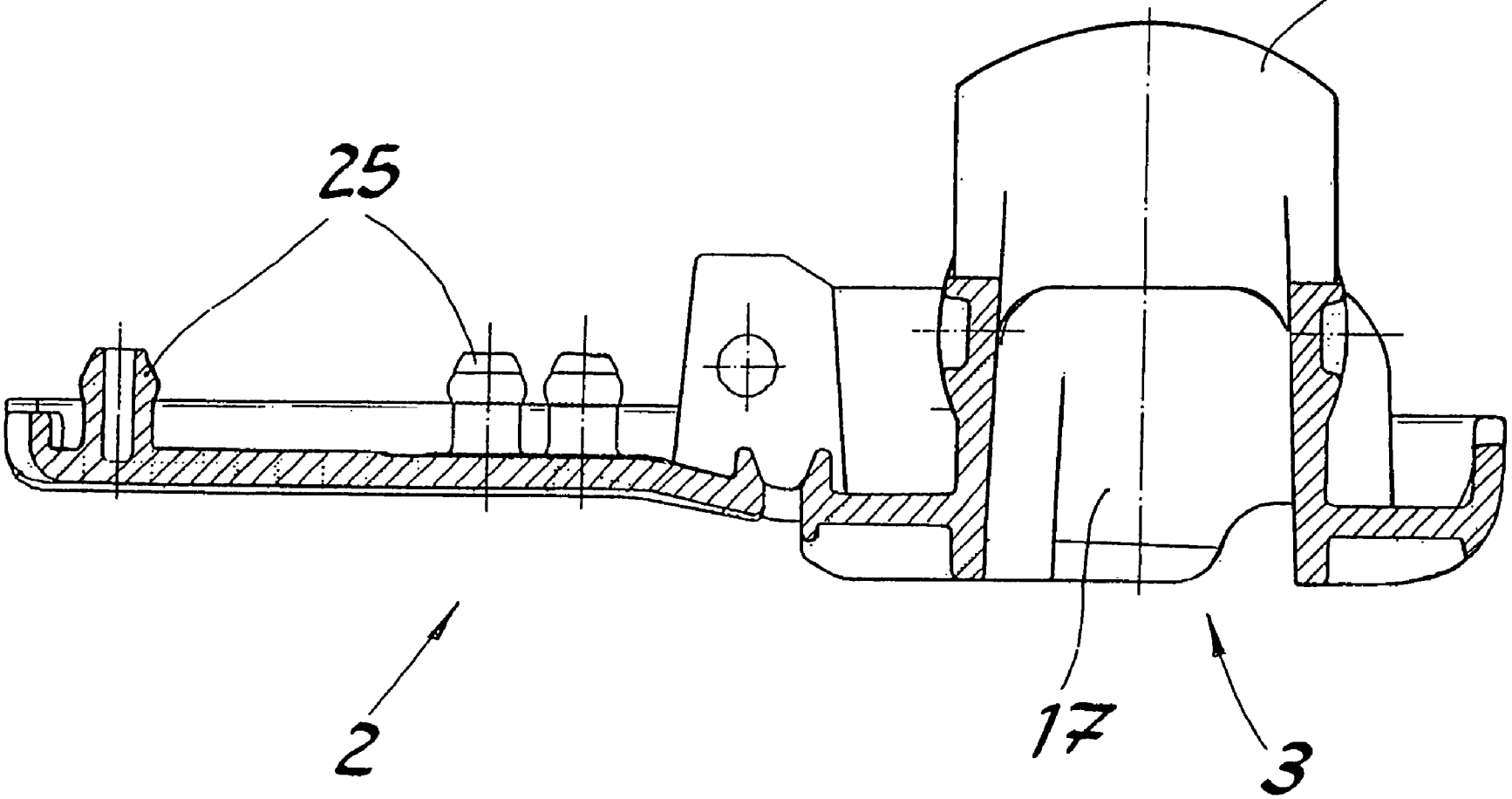
FIG. 6 shows a sectional view along lines VI—VI of FIG. 5.
Figure 7:
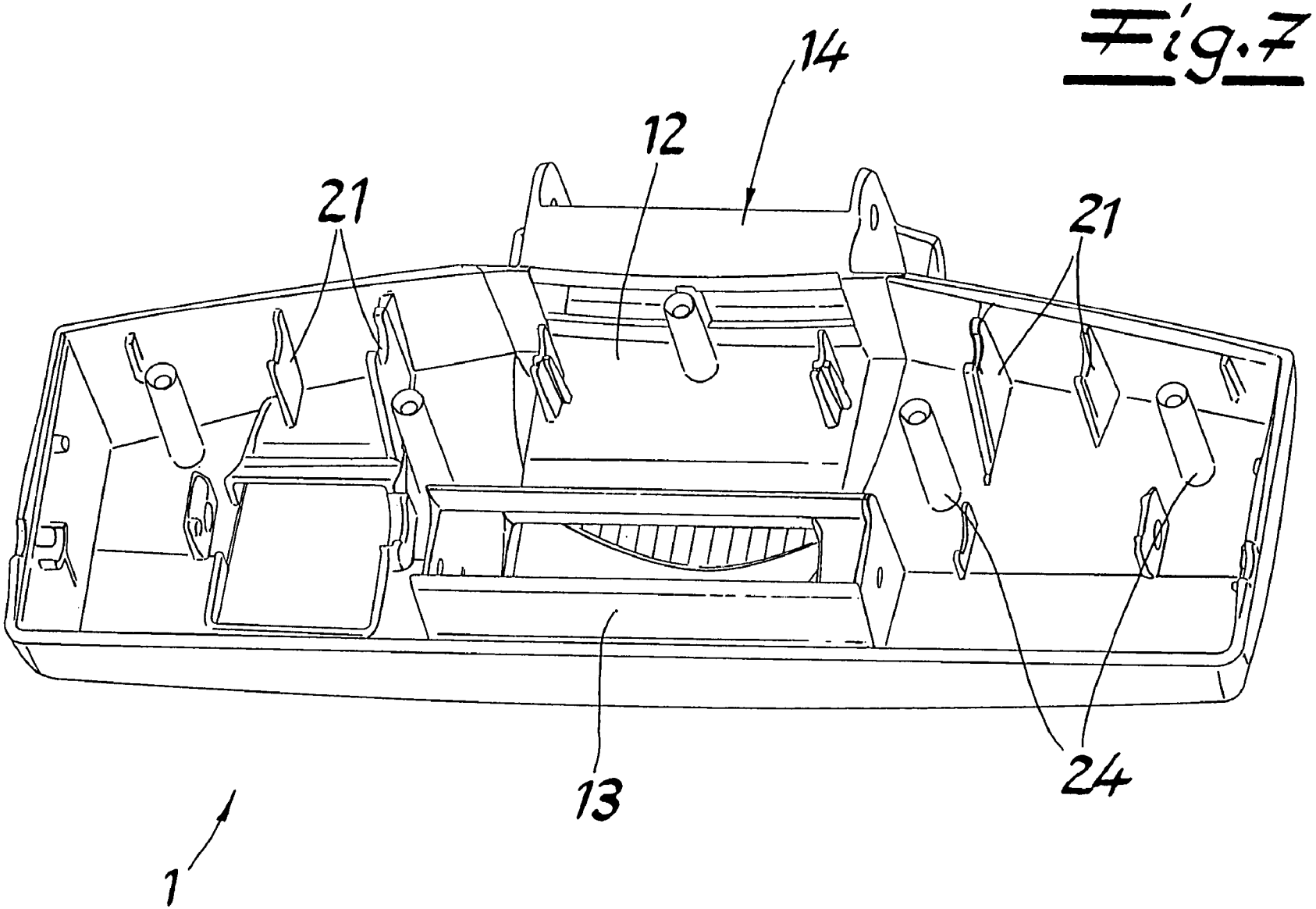
FIG. 7 shows an interior view of the upper part of the vacuum nozzle housing.
Figure 8:
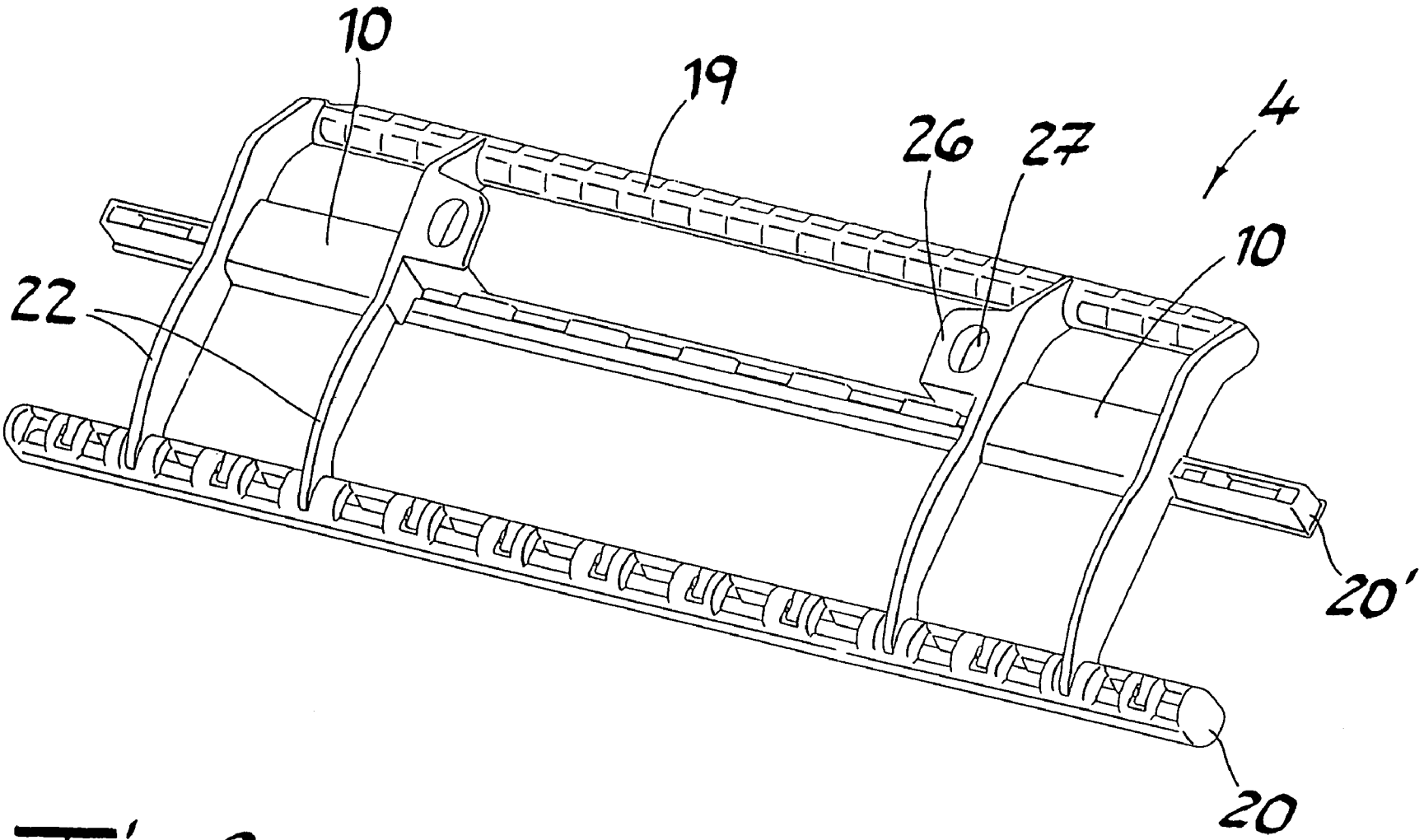
FIG. 8 shows a single component drawing of the gasket base in a representation that is enlarged relative to FIG. 4.

Slide sole 2 is fastened at upper part 1 of the housing with permanent joint slip joints 23 between pivot-shaped projections 24 of the upper part of the housing and counter elements 25 formed onto the slide sole. The counter-elements 25 are developed as stump-shaped cylindrical elements with mushroom head, as shown in FIG. 6.

Figure 5:
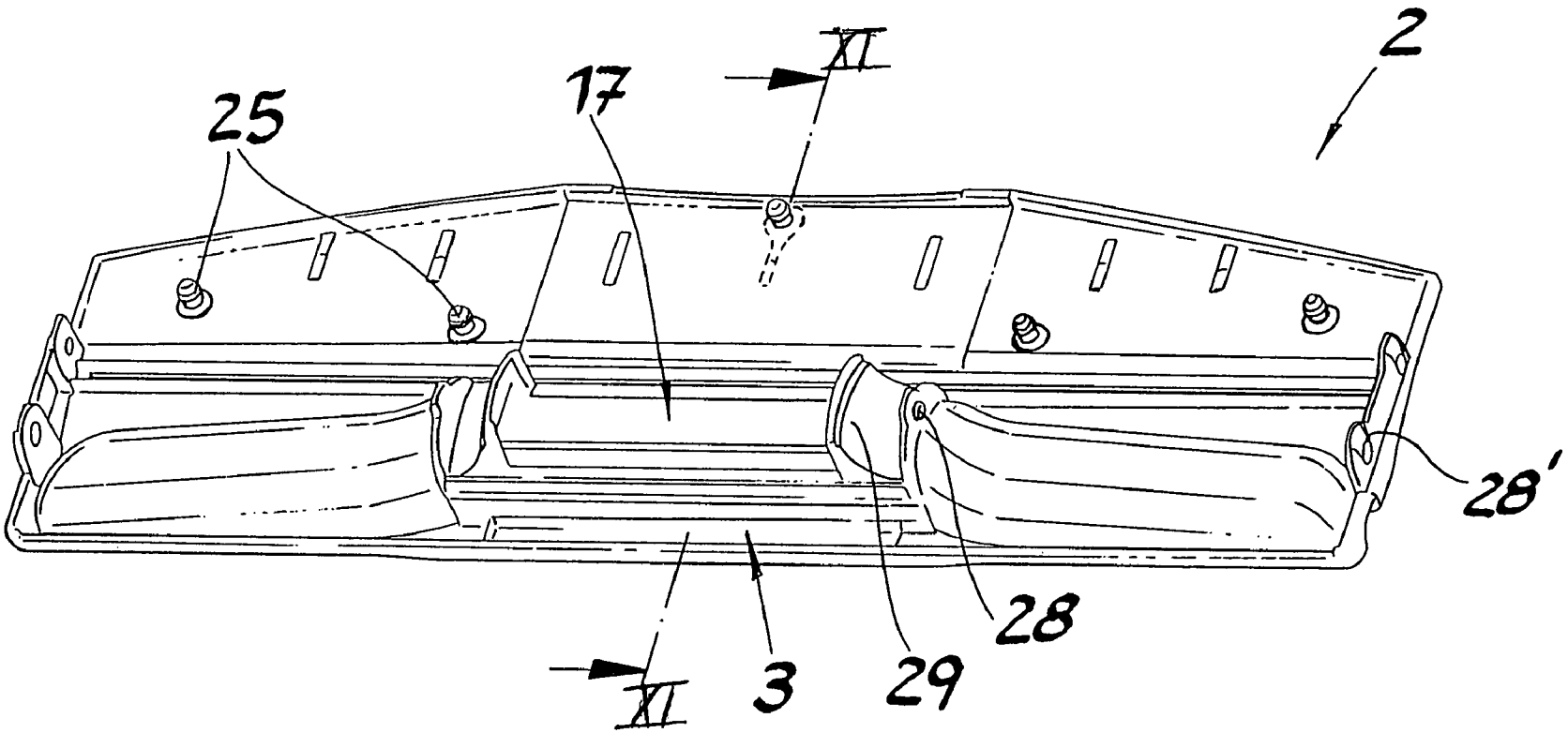
FIG. 5 shows a single component drawing of the slide sole in a representation that is enlarged relative to FIG. 4.

Gasket base 4 is guided at two of the pivots formed by slip joints 23 and has formed support surfaces 26 for return springs 11 with one respective guide recess 27, with the assigned pivot reaching through recess 27. FIG. 2 shows that return springs 11 are arranged on the pivots formed by elements 24, 25 between slide sole 2 and support surfaces 26 of gasket base 4. The pivots formed by slip joints 23 brace the housing of the vacuum cleaner nozzle, which is comprised of slide sole 2 and upper part 1 of the housing, and stabilize slide sole 2. A plurality of counter elements 25 are arranged on a flat segment of slide sole 2, which connects behind suction port 3 in a working direction. In addition, catch projections 28, 28' are formed at slide sole 2, which can be affixed at the connecting piece 13 of upper part 1 of the housing and at the wall surfaces of upper part 1 of the housing (FIG. 1). A comparative view, in particular of FIGS. 1, 5 and 6, furthermore reveals that the opening 17 of slide sole 2, which runs into suction channel 12, is surrounded by formed projections 29 that engage in connecting piece 13 of the suction channel 12 and seal the transition between suction port 3 of slide sole 2 and suction channel 12 of upper part 1 of the housing against extraneous air.

In the embodiment, the gasket base has two respective cross-members 22 on both sides of suction channel 12, which are spaced such that impact switch 8 dips into the free space between adjacent cross-members 22. The contact surfaces 10 cooperating with actuating lever 6 are also arranged between cross-members 22.

Figure 4:
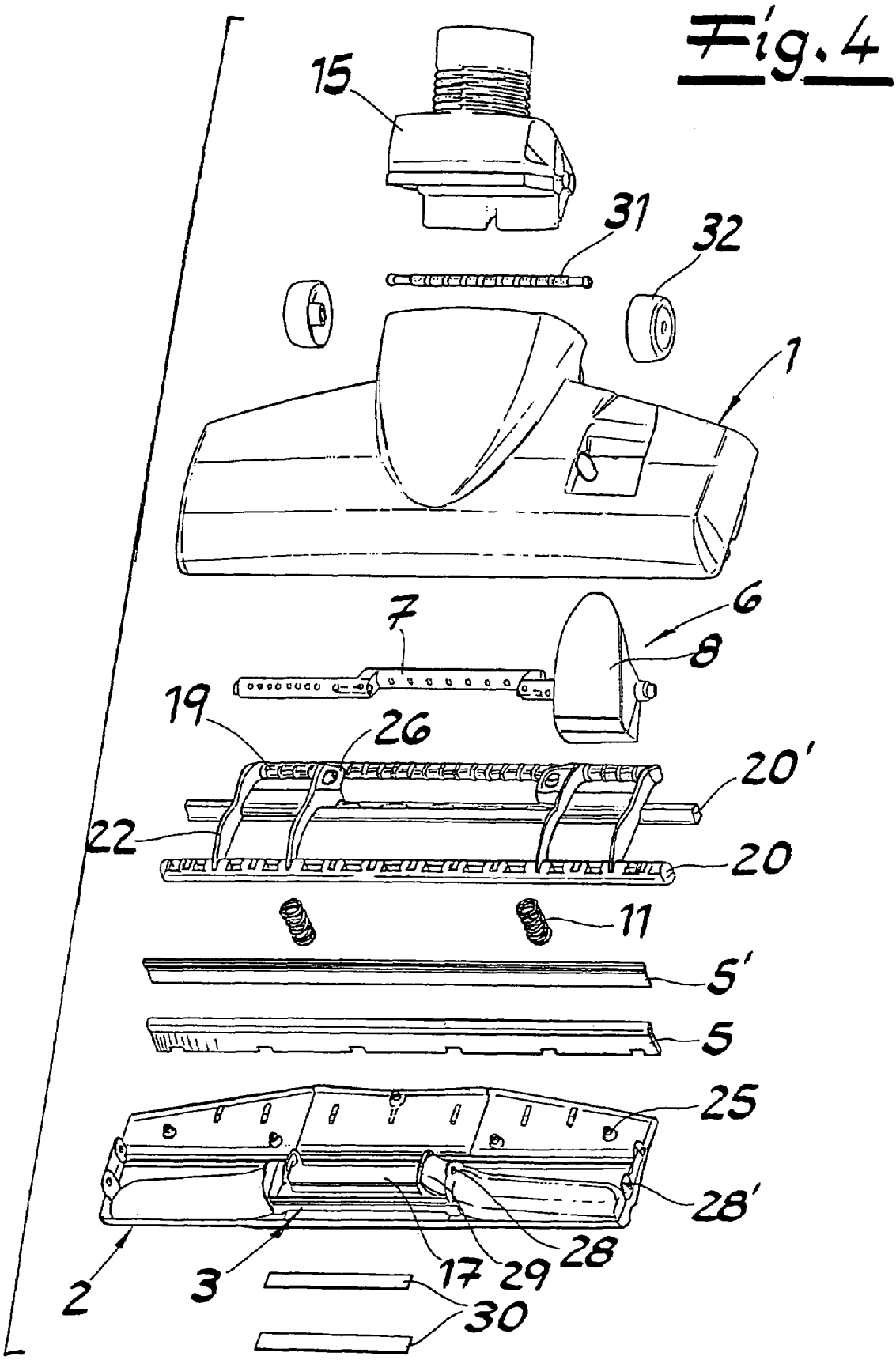
FIG. 4 shows an exploded view of the vacuum cleaner nozzle in accordance with the invention.

In front of and behind suction port 3, slide sole 2 has recesses, with thread lifting strips 30, for example of tilted bristle velour, being glued into said recesses. Furthermore, FIG. 4 shows that hinge joint 15 has an integral shaft axis 31, with wheels 32 being plugged onto the ends of said shaft axis.

Upper part 1 of the housing, slide sole 2, gasket base 4 as well as actuating lever 6 are one-piece plastics moldings that can be produced economically in the injection molding process and are used without machining. During the assembly, actuating lever 6, gasket base 4 as well as return springs 11 are positioned inside upper part 1 of the housing. Then plastic slide sole 2 is engaged with upper part 1 of the housing. The vacuum cleaner nozzle does not comprise any screws and can be produced economically with the use of fully automated assembly facilities.

Accordingly, while only a few embodiments of the present invention have been shown and described, it is obvious that many changes and modifications may be made thereunto without departing from the spirit and scope of the invention.

What is claimed is:

1. A vacuum cleaner nozzle for floors and carpets, comprising:

a housing having an upper part made of plastic and having pivot-shaped projections;

a slide sole with a suction port, said slide sole being connected to the upper part of the housing via slip joints arranged between the pivot-shaped projections of the upper part of the housing and counter elements formed on the slide sole;

a gasket base adjustably arranged inside the upper part of the housing and having at least one strip-shaped gasket element that can be retracted and moved out at a lower side of the nozzle with an adjustment movement of the gasket base, wherein the gasket base is pivotably held in a rear segment of the upper part of the housing in a working direction between formed support webs of the upper part of the housing and the slide sole, and is guided at least at one of the pivots formed by the slip joints;

a tilting lever to operate the gasket base;

return springs that act on the gasket base; and a suction channel formed on the upper part of the housing, said suction channel having on one end a connecting piece connected to the slide sole and a joint cup of a hinged joint on another end, wherein the suction port is comprised of a flow channel formed into the slide sole, which extends from a central opening running into the suction channel transversely to the suction channel.

2. The vacuum cleaner nozzle according to claim 1, wherein the gasket base has formed support surfaces for the return springs of one respective guide recess, with the corresponding pivot reaching through said guide recess, and wherein the return springs are arranged on the pivots between the slide sole and the support surfaces of the gasket base.

3. The vacuum cleaner nozzle according to claim 1, wherein the counter-elements of the slide sole are developed as stump-shaped, cylindrical elements with a mushroom head.

4. The vacuum cleaner nozzle according to claim 3, wherein additional catch projections are formed on the slide sole, which can be affixed to the connecting piece of the upper part of the housing and at wall spaces of the upper part of the housing.

5. The vacuum cleaner nozzle according to claim 1, wherein the gasket base is comprised of:

a pin-jointed frame plastic molding having a rod with cylindrical bearing surfaces;

at least one parallel profile strip that is connected to the gasket element as a longitudinal member;

cross-members connecting the at least one profile strip and being arranged at both sides of the suction channel, wherein the profile strip supporting the gasket element is arranged in a working direction upstream of the connecting piece of the suction channel.

6. The vacuum cleaner nozzle according to claim 5, wherein the gasket base has two profile strips that brace the plastic molding to connect the gasket elements, with the profile strips being arranged in the working direction in front of and behind the suction port.

7. The vacuum cleaner nozzle according to claim 6, wherein the gasket element connected to the profile strip behind the suction port can be retracted and moved out through a gap in the slide sole.

8. The vacuum cleaner nozzle according to claim 7, wherein a bristle strip is connected to the front profile strip and a strip of elastomer material is connected to the rear profile strip.

9. The vacuum cleaner nozzle according to claim 6, wherein a bristle strip is connected to the front profile strip and a strip of elastomer material is connected to the rear profile strip.

10. The vacuum cleaner nozzle according to claim 1, wherein the tilting lever is comprised of a pivotable shaft with at least one actuating surface developed as an impact switch as well as formed cam lobes, with the cam lobes acting on an assigned contact surface of the gasket base.

11. The vacuum cleaner nozzle according to claim 10, wherein the gasket base has two respective cross-members on each side of the suction channel, with the impact switch dipping into a free space between adjacent cross-members and with the contact surfaces that cooperate with the tilting lever also being arranged between the cross-members.

12. The vacuum cleaner nozzle according to claim 1, wherein the slide sole has an opening that is surrounded by formed projections that engage in the connecting piece of the suction channel and seal a transition between the suction port of the slide sole and the suction channel of the upper part of the housing against extraneous air.

13. The vacuum cleaner nozzle according to claim 1, wherein the slide sole has recesses in front of or behind the suction channel and wherein thread lifting strips are glued into said recesses.

14. The vacuum cleaner nozzle according to claim 1, wherein the hinged joint has an integral shaft axis and wherein wheels are plugged onto ends of said shaft axis.

* * * * *